US005965311A

United States Patent [19]

Suzuki

[11] Patent Number: 5,965,311

[45] Date of Patent: Oct. 12, 1999

[54] PHOTOCONDUCTOR FOR ELECTROPHOTOGRAPHY

[75] Inventor: Shinjiro Suzuki, Nagano, Japan

[73] Assignee: Fuji Electric Co., Ltd., Kawasaki, Japan

[21] Appl. No.: 08/991,563

[22] Filed: Dec. 16, 1997

[30] Foreign Application Priority Data

Dec. 17, 1996 [JP] Japan ..... 8-336693

[51] Int. Cl.[6] ..... G03G 5/14

[52] U.S. Cl. ..... 430/60; 430/65

[58] Field of Search ..... 430/63, 65, 60

[56] References Cited

U.S. PATENT DOCUMENTS 5,340,676 8/1994 Anderson et al. ..... 430/63
5,468,584 11/1995 Go et al. ..... 430/63
5,714,248 2/1998 Lewis ..... 430/63

FOREIGN PATENT DOCUMENTS 60-144754 7/1985 Japan .

*Primary Examiner*—John Goodrow
*Attorney, Agent, or Firm*—Kanesaka & Takeuchi

[57] ABSTRACT

The photoconductor of the invention includes a conductive substrate, a photoconductive film on the conductive substrate and an intermediate layer between the conductive substrate and the photoconductive film. The intermediate layer contains first inorganic pigment particles having a primary particle diameter of 0.1 $\mu$m or less, and second inorganic pigment particles having a primary particle diameter from 0.1 to 1.0 $\mu$m. At least 10 wt % of the second inorganic pigment particles is contained in the intermediate layer. The photoconductor prevents interference fringes and image defects, and provides excellent images.

9 Claims, No Drawings

PHOTOCONDUCTOR FOR ELECTROPHOTOGRAPHY

BACKGROUND OF THE INVENTION AND RELATED ART STATEMENT

The present invention relates to a laminate-type photoconductor for electrophotography (hereinafter simply referred to as a "photoconductor") installed on an electrophotographic apparatus which uses coherent or interfering light as a light source. The present invention also relates to a photoconductor which can obtain excellent images free from interference fringes and image defects.

Many conventional photoconductors used in the electrophotographic apparatuses including copying machines, printers and facsimiles which employ Carlson method have used inorganic photoconductive materials, such as selenium, selenium alloys, zinc oxide, and cadmium sulfide. Recently, organic photoconductors which use organic photoconductive materials have been developed vigorously in view of the environmental considerations, ease of film formation and light weight. Among the organic photoconductors, so-called function-separation-type organic photoconductors which include a separate charge generation layer and charge transport layer have been mainly used, because in case the respective layers are formed of the most suitable materials, there are many merits, such as the greatly improved sensitivity and the adjustable spectroscopic sensitivity considering the desired wavelength of the exposure light.

The function-separation-type organic photoconductor generally includes a charge generation layer on a conductive substrate and a charge transport layer on the charge generation layer. The charge generation layer and the charge transport layer constitute a photoconductive film. The photoconductor is manufactured by forming the charge generation layer on the conductive substrate by coating and drying the coating liquid containing a charge generation agent and a binder dispersed and dissolved in a solvent, and by successively forming the charge transport layer on the charge generation layer by coating and drying the coating liquid containing a charge transport agent and a binder dispersed and dissolved in a solvent.

The basic functions required to the photoconductor are obtained by laminating the charge generation layer and charge transport layer directly on the substrate. However, the charge generation layer is generally 0.5 μm or less in thickness for quickly injecting charge carries generated by absorbed light into the substrate and the charge transport layer. Due to the thin charge generation layer, film defects, such as pin holes and non-uniformity, are formed if there are flaws, stains and deposits on the substrate surface. The film defects further cause image defects, such as black spots and uneven printing density. Also, since the charge injection between the substrate and the charge generation layer is not so well prevented, the charge retention rate of the photoconductor is lowered by the holes injected from the substrate. Lowering of the charge retention rate further causes fogging on a white sheet of paper.

It is known that a resin intermediate layer is formed between the substrate and the photoconductive film to prevent image defects by the non-uniformity of the charge generation layer and hole injection from the substrate.

The resins used for the intermediate layer include solvent-soluble polyamide, polyvinyl alcohol, polyvinyl butyral and casein. The intermediate layer that uses one of these resins exhibits its basic functions even when it is extremely thin, e.g., 0.1 μm or thinner. However, the intermediate layer should have the thickness of 0.5 μm or more to cover the defects and stains on the conductive substrate surface or to prevent the non-uniformity of the charge generation layer. Sometimes, the intermediate layer should have the thickness of 1 μm or more depending on the roughness and contamination of the substrate surface.

The thick intermediate layer as described above affects adversely to the carrier injection from the charge generation layer, and causes residual potential rise after repeated use and image defects, such as lowering of printing density. The thick intermediate layer also causes wide variation of the electrical properties of the photoconductor depending on the environment in which the photoconductor is used. Especially, when the photoconductor is used in a hot and very humid environment, the electrical resistance is changed greatly by the dissociation of water absorbed in the thick intermediate layer, and fogging is formed on a solid white image.

Various materials have been proposed for providing such thick intermediate layer with low electrical resistance that changes little with environmental change. Japanese Patent Publications (KOKAI) No. H02-193152, No. H03-288157 and No. H04-31870 disclose solvent-soluble polyamide resins whose chemical structures have been identified. Japanese Patent Publications (KOKAI) No. H02-59458, No. H03-81778 and No. H02-281262 disclose additives for polyamide resin for preventing the electrical resistance from changing by the environmental change. Japanese Patent Publications (KOKAI) No. H03-145652, No. H03-81778 and No. H02-281262 disclose the mixtures of polyamide resin and other resins for adjusting the electrical resistance to suppress the environmental influence on the electrical resistance.

As to the other materials for the intermediate layer, Japanese Patent Publication (KOKAI) No. H02-238459 discloses the employment of cellulose derivatives, Japanese Patent Publications (KOKAI) No. H02-115858 and No. H02-280170 disclose the employment of polyether urethane. Japanese Patent Publication (KOKAI) No. H02-105349 uses polyvinyl pyrrolidone, and Japanese Patent Publication (KOKAI) No. H02-79859 uses polyglycol ether.

When the photoconductor including one of these intermediate layers is used for the laser beam printer, it is necessary to prevent the image defect of interference fringes due to the combination of the refractive index and thickness of the photoconductive film and the wavelength of the light source. In order to prevent the interference fringes, it has been proposed to add an inorganic pigment filler to the intermediate layer. The proposed inorganic pigment fillers for the intermediate layers include small grained aluminum oxide (Japanese Patent Publication (KOKAI) No. H03-24558) and a large amount of rutile-type titanium oxide mixed in acrylmelamine (Japanese Patent Publication (KOKAI) No. H02-67565). An intermediate layer of 2 to 10 μm in thickness that uses anatase-type titanium oxide with the purity of 99% or more has been proposed to improve the dispersing ability of the filler and the electrical properties of the intermediate layer (Japanese Patent Publication (KOKAI) No. H04-172361). This patent publication discloses that anatase-type titanium oxide is superior to rutile-type titanium oxide for improving the dispersing ability of the filler and for lowering the electrical resistance of the intermediate layer.

Japanese Patent Publication (KOKAI) No. S60-144754 discloses an intermediate layer that includes binder resin and conductive powder consisting of coarse powder component of 0.2 to 0.6 μm in average particle diameter and fine powder component of 0.1 μm or less in average particle diameter. However, this combination of the coarse and fine powder components is not so effective to prevent the interference fringes due to the coherent light.

Although various intermediate layers between the conductive substrate and the photoconductive film have been proposed, it is still desirous to develop a laminate-type photoconductor, adaptable to the electrophotographic apparatus which uses coherent or interfering light, such as a laser beam, as a light source, which prevents interference fringes and image defects and which can provide excellent images.

In view of the foregoing, it is an object of the invention to provide a photoconductor for preventing interference fringes and image defects and providing excellent images.

SUMMARY OF THE INVENTION

According to an aspect of the invention, there is provided a photoconductor for electrophotography that includes a conductive substrate, a photoconductive film on the conductive substrate, and an intermediate layer between the conductive substrate and the photoconductive film. The intermediate layer contains first inorganic pigment particles and second inorganic pigment particles having different average particle diameters. The primary particle diameter of the first inorganic pigment particles is 0.1 μm or less, and the primary particle diameter of the second inorganic pigment particles is from 0.1 to 1.0 μm. The amount of the second inorganic pigment particles in the intermediate layer is 10 weight % or more.

Advantageously, the amount of the first inorganic pigment particles in the intermediate layer is 5 weight % or more, and the total amount of the first inorganic pigment particles and the second inorganic pigment particles in the intermediate layer is from 15 to 90 weight %. Preferably, the total amount is from 30 to 80 weight %.

When an image is written by coherent light, such as a laser beam, interference fringes happen to be formed by the reflection of the incident light to the conventional intermediate layer from the substrate surface when the substrate surface is not well covered by the intermediate layer. Generally, the particle diameter which causes the maximum light scattering is around one half of the light wavelength. Sufficient light scattering and, therefore, a photoconductor free from interference fringes are obtained by an intermediate layer containing 10 weight % or more of the inorganic pigment whose primary particle diameter is from 0.1 to 1.0 μm and, preferably, from 0.2 to 0.5 μm. And, by adding the inorganic pigment whose primary particle diameter is 0.1 μm or less and, preferably, from 0.01 to 0.1 μm, defects on the substrate surface are well covered and the surface of the intermediate layer is well flattened. By the above described means, a photoconductor which exhibits excellent electric charge injection is obtained.

DETAILED DESCRIPTION OF PREFERRED EMBODIMENTS

A binder resin is used for the intermediate layer of the invention to improve adhesiveness with the conductive substrate and to improve resistance of the intermediate layer against solvent of a coating liquid for the charge generation layer laminated on the intermediate layer. The binder resins may be polyamide resin, polyester resin, polyurethane resin, polycarbonate resin, epoxy resin, vinyl chloride resin, acrylic resin, polyvinyl ketal resin, phenolic resin, urea resin, melamine resin, guanamine resin and furan resin. Among these resins, melamine resin and polyamide resin are preferable.

On the other hand in case the photoconductor including the intermediate layer as described above is used for the laser beam printer, it is necessary to prevent the defective image due to interference fringes caused by the combination of the refractive index and thickness of the photoconductive film and the wavelength of the light source. To prevent the interference fringes, inorganic filler, such as titanium oxide, zinc oxide, alumina and silica, is added to the intermediate layer of the invention. Especially, when the photoconductor including the intermediate layer is used in the laser printer in which images are written by coherent light, such as a laser beam, white pigment exhibiting a large refractive index is preferably used to prevent the interference fringes. Since the particle diameter which causes maximum light scattering is around one half of the wavelength of the light, at least one of the inorganic pigments used for preventing the interference fringes should be from 0.1 to 1.0 μm in its primary particle diameter and, preferably, from 0.2 to 0.5 μm. And, an amount of the inorganic pigment having the primary particle diameter from 0.1 to 1.0 μm should be 10 wt % or more to effectively interrupt light reflected from the substrate surface.

At least one of the inorganic pigments contained in the intermediate layer for effectively covering the defects on the substrate surface and for smoothening the surface of the intermediate layer should have a primary particle diameter of 0.1 μm or less and, preferably, from 0.01 to 0.1 μm.

The amount of the inorganic pigment with 0.1 μm or less in its primary particle diameter added to the intermediate layer is preferably 5 wt % or more. And, the total amount of the inorganic pigment of 0.1 μm or less in its primary particle diameter and the inorganic pigment of 0.1 to 1.0 μm in its primary particle diameter added to the intermediate layer is preferably from 15 to 90 wt % and, more preferably, from 30 to 80 wt %.

The preferable amount of the binder resin in the intermediate layer is from 5 to 999 weight parts with respect to 100 total weight parts of the inorganic pigments in the intermediate layer.

The intermediate layer has the thickness preferably from 0.3 to 30 μm considering the uniformity of the coated film when formed.

The inorganic pigments for the intermediate layer are dispersed in a dispersion medium with a paint shaker, roll mill, ball mill, attriter, sand grinder and such dispersing means.

As a method of providing the composition combining the binder resin and inorganic pigments described above onto the conductive substrate, a dilute solution of the composition is coated on the conductive substrate. The dilute solution may be coated by the known coating methods, such as dipping method, doctor blade method, bar coater method, roll copying method and spray method. However, the dipping method is especially preferable for coating the dilute solution on the cylindrical conductive substrate.

The conductive substrate used in the invention is made of an aluminum alloy, such as JIS (Japanese Industrial Standards) 3003 series, JIS 5000 series and JIS 6000 series and other metals. The resins, films and paper provided with electrical conductivity may also be used for the conductive substrate of the invention.

The aluminum substrate is finished with a certain dimensional precision by extrusion or drawing processing. The resin substrate may be finished with a certain dimensional precision by injection molding. The surface of the substrate is further finished, if necessary, to exhibit a certain roughness by cutting or grinding with a diamond bite and such surface finishing techniques. The substrate may be used without such further finishing. Then, the substrate is cleaned to remove cutting or machining oils used in cutting and to obtain a clean substrate surface. The detergents may be used for cleaning the substrate, which may be a chlorine containing organic detergent, such as trichloroethylene and freon, and an aqueous detergent, such as weak alkaline detergent.

In the photoconductor of the invention, a charge generation layer is formed on the intermediate layer described above. Materials for a charge generation agent are not limited as far as they are sensitive to the wavelength of the light source. The materials for the charge generation agent may be organic photoconductive materials, such as phthalocyanine pigment, azo pigment, quinacridone pigment, indigo pigment, perylene pigment, polycyclic quinone pigment, anthanthrone pigment and benzimidazole pigment. Such charge generation agent is dispersed or dissolved into a binder resin, such as polyester resin, polyvinyl acetate resin, polymethacrylate resin, polycarbonate resin, polyvinyl butyral resin and phenoxy resin. From 30 to 500 weight parts of the charge generation agent is mixed with 100 weight parts of such a binder resin. The charge generation layer has the thickness preferably from 0.1 to 0.6 $\mu$m.

A charge transport layer is formed on the charge generation layer. Charge transport agents contained in the charge transport layer may be enamine compounds, styryl compounds, amine compounds and butadiene compounds. The charge transport agent is dissolved into a solvent with a resin to which the charge transport agent is well soluble, such as polyester resin, polycarbonate resin, polymethacrylate resin and polystyrene resin. The solution or coating liquid for forming the charge transport layer as described above is coated to become 10 to 40 $\mu$m in dry thickness. Some ingredients, such as antioxidant, ultraviolet ray absorbing agent and leveling agent, may be added to the coating liquid for the charge transport layer. The charge generation layer and charge transport layer constitute the photoconductive film.

Although the present invention will be explained hereinafter by way of embodiments thereof, the present invention is not limited by the embodiments thereof.

Preparation of the inorganic pigment particles

Titanium oxide prepared from titanium tetrachloride was classified into titanium oxide A with the primary particle diameter of 0.01 to 0.1 $\mu$m, titanium oxide B with the primary particle diameter of 0.1 to 1 $\mu$m and titanium oxide C with the primary particle diameter of 1 to 5 $\mu$m. The primary particle diameter of titanium oxide was determined by averaging the diameters of the titanium oxide particles on the micrograph taken under a scanning electron microscope.

Embodiment 1 (E1)

A coating liquid for an intermediate layer of the embodiment 1 was prepared by dissolving 10 weight parts of melamine resin (Uban 2020 supplied from Mitsui Toatsu Chemicals, Inc.) into a solvent mixture of 50 weight parts of methanol and 50 weight parts of methylene chloride, to which 10 weight parts of titanium oxide A and 10 weight parts of titanium oxide B were added. An intermediate layer of 10 $\mu$m in thickness was formed by coating the coating liquid for the intermediate layer on an aluminum substrate of 30 mm in outer diameter and 255 mm in length and by drying the coating liquid at 140° C. for 15 min.

A coating liquid for a charge generation layer of the embodiment 1 was prepared by mixing 2 weight parts of X-type phthalocyanine into 98 weight parts of polyvinyl butyral resin solution dissolved in tetrahydrofuran, and dispersing in a ball mill for 30 hours. A charge generation layer of the embodiment 1 was formed on the intermediate layer by coating the coating liquid for the charge generation layer on the intermediate layer by dip-coating and drying the coating liquid at 100° C. for 10 min.

A coating liquid for a charge transport layer of the embodiment 1 was prepared by uniformly dissolving 10 weight parts of a hydrazone compound (CTC191 supplied from Anan Corporation) and 10 weight parts of polycarbonate (L-1225 supplied from TEIJIN CHEMICALS, LTD.) into 80 weight parts of dichloromethane. A charge transport layer was formed to become 20 $\mu$m in thickness by coating the coating liquid for the charge transport layer on the charge generation layer by dip-coating and by drying the coating liquid at 100° C. for 30 min. Thus, the photoconductor of the embodiment 1 was fabricated.

Embodiment 2 (E2)

A photoconductor of embodiment 2 was fabricated in the similar manner as the photoconductor of the embodiment 1 except that nylon resin (CM4000 supplied from TORAY INDUSTRIES, INC.) was used in the embodiment 2 in substitute for the melamine resin of the embodiment 1.

Embodiment 3 (E3)

A photoconductor of embodiment 3 was fabricated in the similar manner as the photoconductor of the embodiment 1 except that titanium oxide E (TTO-55 supplied from Ishihara Industry Co., Ltd., primary particle diameter: from 0.02 to 0.05 $\mu$m) was used in the embodiment 3 in substitute for the titanium oxide A of the embodiment 1.

Embodiment 4 (E4)

A photoconductor of embodiment 4 was fabricated in the similar manner as the photoconductor of the embodiment 1 except that titanium oxide F (TA-300 supplied from Fuji Titanium Co., Ltd., primary particle diameter: 0.3 $\mu$m) was used in the embodiment 4 in substitute for the titanium oxide B of the embodiment 1.

COMPARATIVE EXAMPLE 1 (C1)

A photoconductor of comparative example 1 was fabricated in the similar manner as the photoconductor of the embodiment 1 except that titanium oxide A of the embodiment 1 was not added to the intermediate layer of the comparative example 1.

COMPARATIVE EXAMPLE 2 (C2)

A photoconductor of comparative example 2 was fabricated in the similar manner as the photoconductor of the embodiment 1 except that titanium oxide B of the embodiment 1 was not added to the intermediate layer of the comparative example 2.

COMPARATIVE EXAMPLE 3 (C3)

A photoconductor of comparative example 3 was fabricated in the similar manner as the photoconductor of the embodiment 1 except that titanium oxide C was used in the comparative example 3 in substitute for titanium oxide A of the embodiment 1.

COMPARATIVE EXAMPLE 4 (C4)

A photoconductor of the comparative example 4 was fabricated in the similar manner as the photoconductor of the embodiment 1 except that titanium oxide C was used in the comparative example 4 in substitute for titanium oxide B of the embodiment 1.

The photoconductors fabricated as described above were installed on laser beam printers, and were evaluated by their initial printing images and images after 50000 times of printing in an ordinary environment (25° C., 50% RH), a cool and dry environment (10° C., 20% RH), and a hot and humid environment (30° C., 90% RH). The printing density (solid black density) was measured with a Macbeth densitometer. Table 1 lists the evaluation results in the ordinary environment. Table 2 lists the evaluation results in the cool and dry environment. And, Table 3 lists the evaluation results in the hot and humid environment.

TABLE 1

| | Initial images | | | Images after 50000 times of printing | | |
|---|---|---|---|---|---|---|
| | Interference fringes | Black spots on white background | Solid black density | Interference fringes | Black spots on white background | Solid black density |
| E1 | Not caused | Not caused | 1.42 | Not caused | Not caused | 1.40 |
| E2 | Not caused | Not caused | 1.42 | Not caused | Not caused | 1.42 |
| E3 | Not caused | Not caused | 1.41 | Not caused | Not caused | 1.40 |
| E4 | Not caused | Not caused | 1.42 | Not caused | Not caused | 1.39 |
| C1 | Not caused | Small back spots caused | 1.39 | Not caused | Small back spots caused | 1.30 |
| C2 | Caused | Not caused | 1.39 | Caused | Not caused | 1.37 |
| C3 | Not caused | Small back spots caused | 1.39 | Not caused | Small back spots caused | 1.33 |
| C4 | Not caused | Small back spots caused | 1.34 | Not caused | Small back spots caused | 1.33 |

TABLE 2

| | Initial images | | | Images after 50000 times of printing | | |
|---|---|---|---|---|---|---|
| | Interference fringes | Black spots on white background | Solid black density | Interference fringes | Black spots on white background | Solid black density |
| E1 | Not caused | Not caused | 1.39 | Not caused | Not caused | 1.38 |
| E2 | Not caused | Not caused | 1.41 | Not caused | Not caused | 1.40 |
| E3 | Not caused | Not caused | 1.40 | Not caused | Not caused | 1.40 |
| E4 | Not caused | Not caused | 1.41 | Not caused | Not caused | 1.39 |
| C1 | Not caused | Small back spots caused | 1.39 | Not caused | Small back spots caused | 1.29 |
| C2 | Caused | Not caused | 1.39 | Caused | Not caused | 1.35 |
| C3 | Not caused | Small back spots caused | 1.39 | Not caused | Small back spots caused | 1.32 |
| C4 | Not caused | Small back spots caused | 1.34 | Not caused | Small back spots caused | 1.30 |

TABLE 3

| | Initial images | | | Images after 50000 times of printing | | |
|---|---|---|---|---|---|---|
| | Interference fringes | Black spots on white background | Solid black density | Interference fringes | Black spots on white background | Solid black density |
| E1 | Not caused | Not caused | 1.40 | Not caused | Not caused | 1.40 |
| E2 | Not caused | Not caused | 1.40 | Not caused | Not caused | 1.39 |
| E3 | Not caused | Not caused | 1.39 | Not caused | Not caused | 1.39 |
| E4 | Not caused | Not caused | 1.41 | Not caused | Not caused | 1.40 |
| C1 | Not caused | Small back spots caused | 1.36 | Not caused | Small back spots caused | 1.31 |
| C2 | Caused | Not caused | 1.38 | Caused | Not caused | 1.35 |
| C3 | Not caused | Small back spots caused | 1.38 | Not caused | Small back spots caused | 1.29 |
| C4 | Not caused | Small back spots caused | 1.37 | Not caused | Small back spots caused | 1.28 |

As Tables 1, 2 and 3 indicate, the photoconductors of the embodiments 1 through 4 did not cause any interference fringes, black spots and lowering of printing density in their images after 50000 times of printing as well as in their initial images in the ordinary environment, cool and dry environment, and hot and humid environment.

As explained above, the photoconductor of the invention prevents interference fringes and image defects. Thus, the photoconductor of the invention can provide quite excellent images.

What is claimed is:

1. A photoconductor for electrophotography comprising:

a conductive substrate;

a photoconductive film on said conductive substrate; and an intermediate layer situated between said conductive substrate and said photoconductive film, said intermediate layer containing first inorganic pigment particles having a primary particle diameter of at most 0.1 μm and second inorganic pigment particles having a primary particle diameter from 0.1 to 1.0 μm, said first and second inorganic pigment particles being made of a same material, at least 10 wt % of said second inorganic pigment particles being contained in said intermediate layer.

2. A photoconductor according to claim 1, wherein an amount of said first inorganic pigment particles in said intermediate layer is at least 5 wt %, and a total amount of said first and second inorganic pigment particles in said intermediate layer is from 15 to 90 wt %.

3. A photoconductor according to claim 2, wherein said total amount of the first and second inorganic pigment particles is from 30 to 80 wt %.

4. A photoconductor according to claim 2, wherein said intermediate layer further includes a binder resin, 5–999 parts by weight of said binder resin being mixed with 100 parts by weight of the total amount of the first and second inorganic pigment particles.

5. A photoconductor according to claim 4, wherein said intermediate layer has a thickness of 0.3–30 μm.

6. A photoconductor according to claim 5, wherein said photoconductive film includes a charge generation layer disposed on the intermediate layer, and a charge transport layer disposed on the charge generation layer.

7. A photoconductor according to claim 1, wherein said first and second inorganic pigment particles are white pigments for exhibiting a large refractive index to prevent interference fringes.

8. A photoconductor according to claim 7, wherein said second inorganic pigment particles provide light scattering for coherent light applied to the photoconductor, and said first inorganic pigment particles cover defects on a surface of the conductive substrate and provide smoothness on the intermediate layer.

9. A photoconductor according to claim 1, wherein said material for the first and second inorganic pigment particles is selected from a group consisting of titanium oxide, zinc oxide, alumina and silica.

* * * * *